US005429124A

United States Patent [19]

Yoshida et al.

[11] Patent Number: 5,429,124

[45] Date of Patent: Jul. 4, 1995

[54] MOUTHPIECE FOR SEMI-CLOSED TYPE OF BREATHING APPARATUS

[75] Inventors: Akihiko Yoshida; Yasushi Yoshida, both of Saitama, Japan

[73] Assignee: Zexel Corporation, Tokyo, Japan

[21] Appl. No.: 162,937

[22] Filed: Dec. 8, 1993

[30] Foreign Application Priority Data

Dec. 22, 1992 [JP] Japan ..... 4-356944

[51] Int. Cl.[6] ..... B63C 11/24

[52] U.S. Cl. ..... 128/204.29; 128/204.26; 137/908; 137/493

[58] Field of Search ..... 125/204.29, 207.14, 125/207.16, 204.26, 205.24; 137/908, 493; 251/333

[56] References Cited

U.S. PATENT DOCUMENTS

| | | | |
|---|---|---|---|
| 3,149,631 | 9/1964 | Svenson | 137/908 |
| 3,179,118 | 4/1965 | Mitchell et al. | 137/908 |
| 3,795,257 | 3/1974 | Fabish et al. . | |
| 3,805,778 | 4/1974 | Garrahan . | |
| 3,995,625 | 12/1976 | Needham . | |
| 4,010,746 | 3/1977 | Pedersen . | |
| 4,076,041 | 2/1978 | Christianson | 137/490 |
| 4,306,584 | 12/1981 | Schlobohm | 137/908 |
| 4,572,176 | 2/1986 | Walther | 137/908 |
| 4,793,340 | 12/1988 | Ottestad | 128/200.24 |
| 5,052,383 | 10/1991 | Chabert | 128/204.26 |
| 5,222,490 | 6/1993 | Pomerantz et al. | 137/908 |
| 5,259,375 | 11/1993 | Schuler | 128/204.26 |
| 5,368,018 | 11/1994 | Stone | 128/205.24 |

*Primary Examiner*—Edgar S. Burr
*Assistant Examiner*—William J. Deane, Jr.
*Attorney, Agent, or Firm*—Sughrue, Mion, Zinn, Macpeak & Seas

[57] ABSTRACT

A mouthpiece for a semi-closed type of breathing apparatus for removing carbon dioxide from breathing air circulating from an inhaling port to an exhaling port in a breathing circuit, comprising a casing, a diaphragm which expands when the inner pressure of a casing is increased through an exhaling operation, exhaling valve member for opening and closing the exhaling port, an urging device for urging the exhaling valve member in such a direction as to close the exhaling port, and a lever having one end linked to the exhaling valve member and the other end linked to the diaphragm, the exhaling valve member being opened through the lever when the inner pressure of the casing is increased through the exhaling operation and the diaphragm expands. The exhaling valve member is urged by the urging device to thereby surely close the exhaling port, so that the exhaling valve is completely prevented from being opened due to the weight of water intruding into the mouthpiece, and thus water in the mouthpiece can be surely prevented from intruding into the breathing circuit.

4 Claims, 3 Drawing Sheets

MOUTHPIECE FOR SEMI-CLOSED TYPE OF BREATHING APPARATUS

BACKGROUND OF THE INVENTION

1. Field of the Invention

This invention relates to a mouthpiece for a semi-closed type of breathing apparatus in which carbon dioxide is removed from breathing air circulating in a breathing circuit, breathing air is supplied into the breathing circuit, and surplus breathing air is discharged to the outside.

2. Description of Related Art

In general, this semi-closed type of breathing apparatus is equipped with a mouthpiece, a carbon dioxide absorber (canister) for absorbing carbon dioxide and a breathing gas bomb (an air tank). In the semi-closed type of breathing apparatus thus constructed, carbon dioxide is removed from breathing air (gas) circulating in the breathing circuit by the canister, and the breathing air is supplied from the air tank into the breathing circuit while surplus breathing air is discharged from the breathing circuit.

As a conventional breathing apparatus has been well known one as disclosed in Japanese Laid-open Utility Mode Application No. 1-134598. The mouthpiece of the breathing apparatus as disclosed in this publication has a breathing chamber in a case thereof, and the breathing chamber is formed with an air inhaling port and an air exhaling port. A check valve which is opened through an air inhaling operation is provided at the inhaling port, and the air inhaling port is opened or closed by the operation of the check valve.

On the other hand, a slide member is provided at the air exhaling port side, and the air exhaling port is opened or closed by the movement of the slide member in the breathing operation. If water intrudes into the breathing chamber, the slide member is moved by a hand to intercommunicate a drain port formed in the case with the breathing chamber, and the water which has intruded into the breathing chamber through the drain port is blown out while closing the drain port in the air exhaling operation.

In the conventional semi-closed type of breathing apparatus as described above, the slide member also serves as an exhaling valve, and thus the apparatus is so designed that the exhaling port is closed through the movement of the slide member. Accordingly, when water intrudes through a breathing port of the mouthpiece, there occurs an unfavorable case where water is liable to intrude into the breathing circuit through the opened exhaling port. The intrusion of water into the breathing circuit causes the function of the carbon dioxide absorber to be damaged. Further, in the semi-closed type of breathing apparatus, a check valve is provided at each of the air exhaling port and the air inhaling port. The air inhaling port is ordinarily closed, and it is opened only in the air exhaling operation. In this valve structure, the air exhaling port may be opened by the weight of water itself, so that the intrusion of water cannot be prevented.

SUMMARY OF THE INVENTION

An object of this invention is to provide a mouthpiece for a semi-closed type of breathing apparatus in which the intrusion of water through an air exhaling port into a breathing circuit can be surely prevented.

In order to attain the above object, a mouthpiece for a semi-closed type of breathing apparatus for removing carbon dioxide from breathing air circulating from an inhaling port to an exhaling port in a breathing circuit, comprises a casing, a diaphragm which expands when the inner pressure of a casing is increased through an exhaling operation, an exhaling valve member for opening and closing the exhaling port, urging means for urging the exhaling valve member in such a direction as to close the exhaling port, and a lever having one end linked to the exhaling valve member and the other end linked to the diaphragm, the exhaling valve member being opened through the lever when the inner pressure of the casing is increased through the exhaling operation and the diaphragm expands.

According to the mouthpiece for the semi-closed type of breathing apparatus of this invention, the exhaling valve member of the exhaling port is urged by the urging means to surely close the exhaling port. Therefore, the exhaling valve is completely prevented from opening by the weight of water intruding into the mouthpiece, and thus water in the mouthpiece can be surely prevented from intruding into the breathing circuit.

In the breathing operation, the exhaling operation of a user increases the inner pressure of the casing to expand the diaphragm and move the lever linked to the diaphragm interlockingly with the expanding motion of the diaphragm, so that the exhaling valve is moved against the urging force of the urging means and the exhaling valve is opened. Accordingly, a normal breathing operation is allowed to be carried out.

Further, in the structure that the casing of the mouthpiece is provided with the drain valve, if water intrudes into the mouthpiece, the user may blow air into the mouthpiece to temporarily increase the inner pressure of the casing, so that the drain valve is opened and water is splashed out. In this case, the user is required to press the diaphragm with his hand so that the exhaling valve is not opened. Accordingly, the water intruding into the mouthpiece can be surely and easily drained from the casing, and thus it can be surely prevented from intruding into the breathing circuit.

DETAILED DESCRIPTION OF THE PREFERRED EMBODIMENT

A preferred embodiment according to this invention will be described hereunder with reference to FIGS. 1 to 6.

Figure 4:
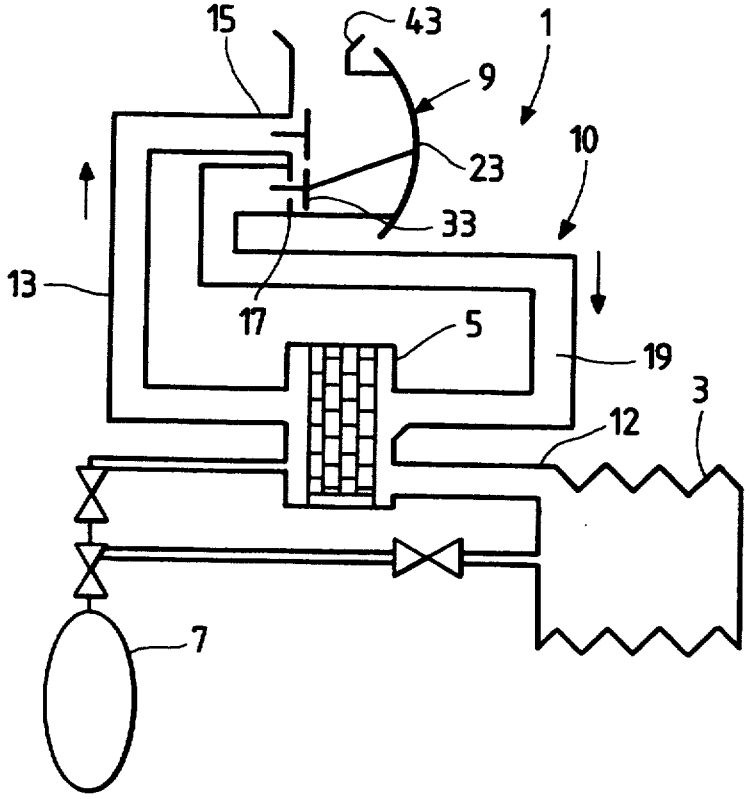
FIG.4 is a schematic diagram showing the construction of the semi-closed type of breathing apparatus as shown in FIG. 1.

As schematically shown in FIG. 4, a semi-closed type of breathing apparatus according to this embodiment comprises a breathing bag 3, a canister (carbon dioxide absorber) 5, a breathing gas bomb (air tank) 7 and a mouthpiece 9. In an air inhaling operation, breathing air in a breathing circuit 10 is supplied from the breathing bag 3 through a line 12, the canister 5, the inhaling duct 13 and an air inhaling port 15 into the mouthpiece 9. On the other hand, in an air exhaling operation, breathing air exhaled from the mouthpiece 9 is supplied through an exhaling duct 19 connected to the exhaling port 17 into the breathing bag 3. In addition, a constant amount of air is supplied from the breathing gas bomb 7 into the breathing circuit 10.

Figure 1:
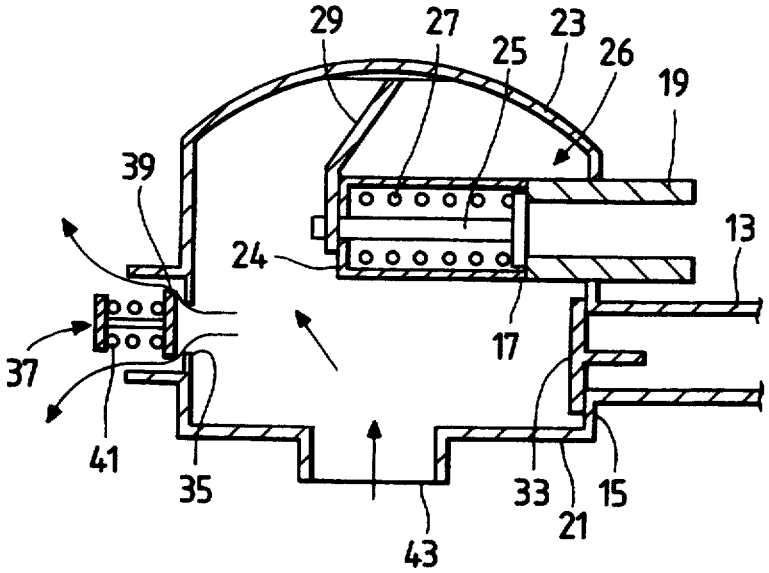
FIG. 1 is a shematical cross-sectional view showing the construction of a mouthpiece for a semi-closed type of breathing apparatus of an embodiment according to this invention.
Figure 2:
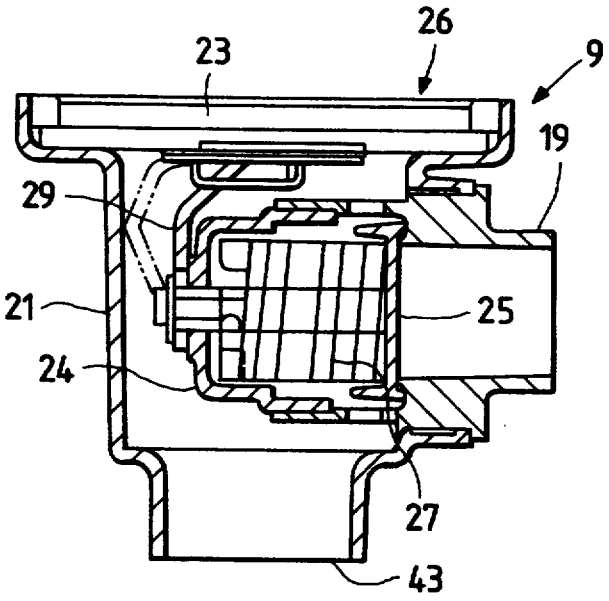
FIG. 2 is a cross-sectional view of the mouthpiece for the semi-closed type of breathing apparatus as shown in FIG. 1.
Figure 3:
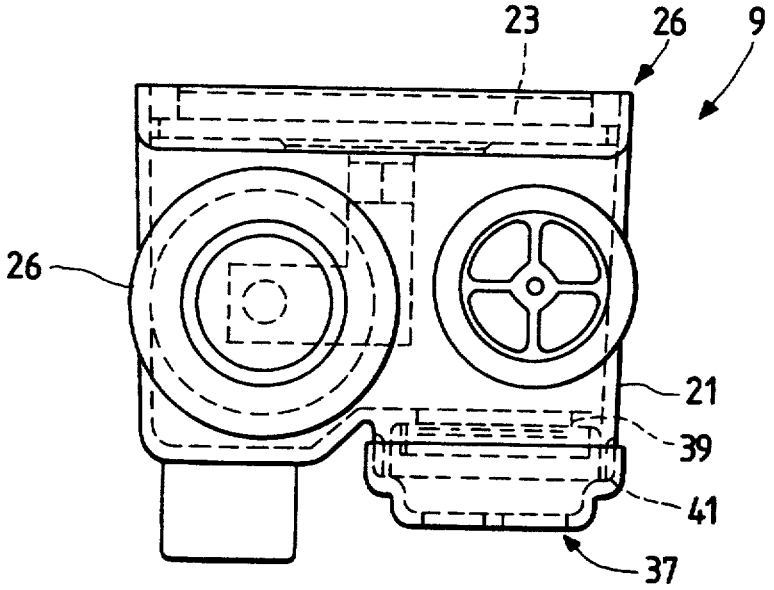
FIG. 3 is a side view showing the mouthpiece for the semi-closed type of breathing apparatus as shown in FIG. 1.

As shown in FIGS. 1 to 3, the mouthpiece 9 is provided with a diaphragm 23 at one side of a casing 21 thereof, and the diaphragm 23 is so designed to be expanded in accordance with the inner pressure of the casing 21.

The casing 21 is provided with the exhaling port 17 which is connected to the exhaling duct 19, and the exhaling port 17 is so designed to be opened or closed by the operation of the exhaling valve 26. The exhaling valve 26 includes an exhaling valve member 25 for closing the exhaling port 17, and a coil spring 27 serving as urging means for urging the exhaling valve member 25 in such a direction as to close the exhaling port 17, and the exhaling port 17 is closed when the exhaling valve member 25 is seated on the exhaling port 17. The exhaling valve member 25 is urged by the coil spring 27 which is supported by a supporter 24, and it is ordinarily urged against the exhaling port 17 to close the exhaling port 17.

One end portion of a lever 29 is linked to the rear end portion of the exhaling valve member 25, and the other end portion of the lever 29 is linked to the diaphragm 23 as described above. When the diaphragm 23 is expanded, the lever 29 is moved interlockingly with the expanding motion of the diaphragm 23, so that the other end portion of the lever 29 moves the exhaling valve member 25 in the horizontal direction against the urging force of the coil spring 27, and the exhaling port 17 is opened.

A flexible exhaling valve member 33 which is composed of flexible material is provided at the inhaling port 15 connected to the inhaling duct 13, and the flexible inhaling valve member 33 is deformed in accordance with the inner pressure of the casing to open the inhaling port 15.

The casing 21 is further formed with a drain port 35 for draining water intruding into the casing, and the drain port 35 is ordinarily closed by a drain valve 37. The drain valve 37 comprises a drain valve member 39 or closing the drain port 35 when it is seated on the drain port 35, and a coil spring 41 for biasing the drain valve member 39 against the drain port 35. When the inner pressure of the casing 21 exceeds a predetermined value, the drain valve member 39 is moved against the biasing force of the coil spring 41 by the pressure, and the drain port 35 is opened. A reference numeral 43 represents the breathing port through which a user breathes.

Next, the operation of this embodiment according to the present invention will be described with reference to FIGS. 1, 5 and 6.

Figure 5:
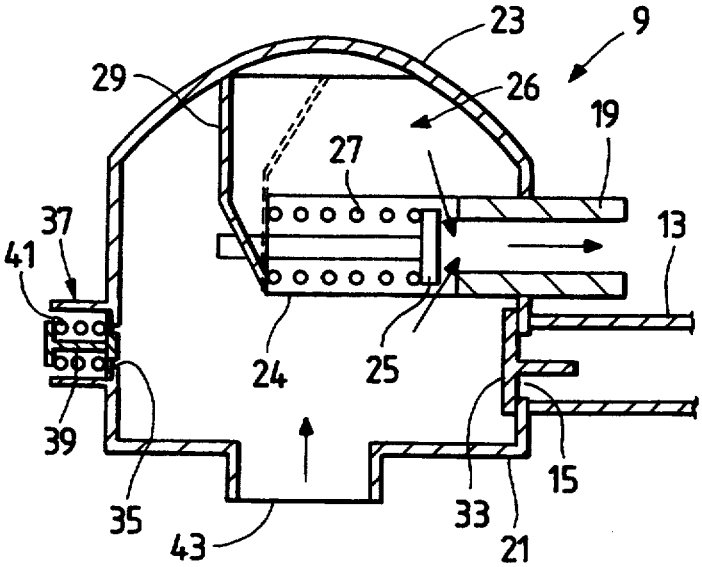
FIG. 5 is a cross-sectional view of the operation state of the mouthpiece for the semi-closed type of breathing apparatus as shown in FIG. 1.

In the breathing operation under water, firstly, in the exhaling operation, when the inner pressure of the casing 21 is increased through an exhaling operation of a user as shown in FIG. 5, the diaphragm 23 is expanded, and the lever 29 is moved from a position as indicated by a broken line to a position indicated by a solid line. Through this motion, the end portion of the exhaling valve member 25 which is linked to the lever 29 is moved to the left in FIG. 5 against the urging force of the coil spring 27, thereby opening the exhaling port 17. Through this operation, the exhaled air flows into the exhaling duct 19.

Figure 6:
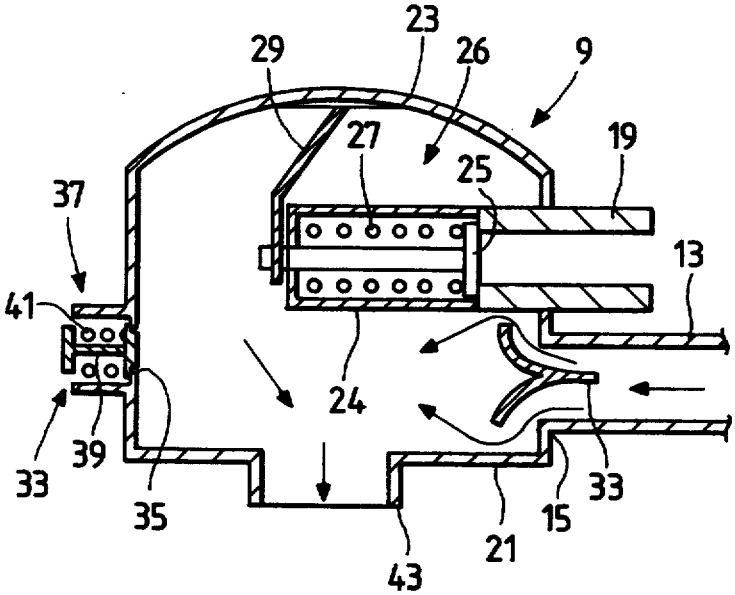
FIG. 6 is a cross-sectional view of the operational state of the mouthpiece during inhaling.

On the other hand, in the inhaling operation, the inner pressure of the casing 21 is decreased as shown in FIG. 6, so that the flexible inhaling valve member 33 is deformed to open the inhaling port 15, and the inhaling air is allowed to flow in from the inhaling duct 13. In this case, the exhaling valve 26 is closed.

Here, when the user detaches the mouthpiece from his mouth under water or the like, there may occur a case where water intrudes into the mouthpiece. In this case, the user may strongly blow air into the mouthpiece while pressing the diaphragm with his finger, thereby draining the intruding water.

Through such an air blow-in (exhaling) operation, the inner pressure of the casing 21 is rapidly increased as shown in FIG. 1, however, the lever is not moved because the expansion of the diaphragm is inhibited by the user's finger. Accordingly, only the drain valve member 39 of the drain valve 37 is moved against the urging force of the spring 41 while the exhaling port 17 is closed by the exhaling valve 25, so that the drain port 35 is opened and water in the casing is drained.

In the state where the water intrudes into the casing 21, the inhaling valve member 33 is prevented from being deformed due to the weight of water itself because the inhaling valve member 33 comprises a check valve. Accordingly, water is prevented from intruding through the inhaling port 15 into the inhaling duct 13. Further, with respect to the exhaling valve 26, the exhaling port 17 is also closed by the exhaling valve member 25 which is pressed by the urging force of the coil spring 27, and thus the valve member 25 is prevented from being opened or leaking due to the weight of water itself.

This invention is not limited to the above embodiment, and various modifications may be made without departing from the subject matter of this invention. For example, the valve member 39 of the drain valve 37 may be of a type that does not necessarily have to be pressed by the spring 41, and it may comprise a flexible valve member or the like insofar as it is opened when the inner pressure of the casing is increased.

What is claimed is:

1. A mouthpiece for use in a semi-closed type of breathing apparatus for removing carbon dioxide from breathing air circulating from an inhaling duct to an exhaling duct in a breathing circuit, said mouthpiece comprising:

a casing including a breathing port through which a user breathes, an inhaling port which is connected to the inhaling duct, and an exhaling port which is connected to the exhaling duct;

a diaphragm disposed at one side of said casing and which expands when an inner pressure of said casing is increased through an exhaling operation;

an exhaling valve member for opening and closing said exhaling port;

urging means for urging said exhaling valve member in such a direction as to close said exhaling port; and a lever having one end linked to said exhaling valve member and the other end linked to said diaphragm, said exhaling valve member being opened by said layer responsive to inner pressure of said casing being increased through the exhaling operation and expanding said diaphragm, wherein said casing further including a drain port and a pressure responsive drain valve which is opened automatically in response to the inner pressure of said casing exceeding a predetermined pressure through the exhaling operation, said diaphragm having an outer surface which is externally exposed for being manually contacted by the user.

2. The mouthpiece as claimed in claim 1, wherein said pressure responsive drain valve includes a drain valve member for closing said drain port, and biasing means for biasing said drain valve member with a force which equals the predetermined pressure.

3. The mouthpiece as claimed in claim 1, wherein said exhaling valve member includes a rear end portion which extends rearwardly, and wherein said exhaling valve member, said rear end portion and said urging means are integrally accommodated in said casing, and said lever is linked to said rear end portion projecting from said casing.

4. The mouthpiece as claimed in claim 1, wherein said inhaling port includes a flexible valve member, said flexible valve member being deformed in accordance with the inner pressure of said mouthpiece to open or close said inhaling port.

* * * * *